US005934132A

United States Patent [19]

Nichol

[11] Patent Number: 5,934,132

[45] Date of Patent: Aug. 10, 1999

[54] OFFSET BENDER FOR TUBING

[75] Inventor: Brian W. Nichol, Guelph, Canada

[73] Assignee: Applied Power Inc., Butler, Wis.

[21] Appl. No.: 09/076,177

[22] Filed: May 11, 1998

[51] Int. Cl.[6] ..... B21D 7/022

[52] U.S. Cl. ..... 72/301; 72/316; 72/386

[58] Field of Search ..... 72/301, 305, 311, 72/386, 385, 384, 388, 298, 316, 319

[56] References Cited

U.S. PATENT DOCUMENTS

| | | | |
|---|---|---|---|
| 404,164 | 5/1889 | Buckman | 72/319 |
| 940,360 | 11/1909 | Richards | 72/319 |
| 996,064 | 6/1911 | Costello | 72/385 |
| 1,001,244 | 8/1911 | Brown | 72/301 |
| 2,401,031 | 5/1946 | Wanasek | 72/319 |
| 2,771,934 | 11/1956 | Payne | 72/386 |
| 2,893,461 | 7/1959 | Pauling | 72/301 |
| 2,908,317 | 10/1959 | Sadler | 72/385 |
| 3,000,423 | 9/1961 | Aris | 72/301 |
| 3,691,815 | 9/1972 | Deacon | 72/458 |
| 3,875,786 | 4/1975 | Wright | 72/380 |
| 4,537,052 | 8/1985 | Adleman | 72/154 |
| 4,747,768 | 5/1988 | Crupi | 425/392 |
| 4,829,806 | 5/1989 | Wright | 72/459 |
| 5,222,384 | 6/1993 | Evans | 72/34 |

OTHER PUBLICATIONS

Exhibit A; p. 3 of Greenlee Textron Inc. catalog showing Little Kicker® Offset Bender, admitted prior art.

Exhibit B; Ridgid "Tubing Tools" page showing inner–outer reamers and deburring tool, admitted prior art.

*Primary Examiner*—Daniel C. Crane

*Attorney, Agent, or Firm*—Quarles & Brady

[57] ABSTRACT

An offset conduit bender has a pair of shoes which are pivotally connected to one another so that axes of the shoes remain parallel. Each shoe has a specially shaped groove in it for receiving a tube inserted into the grooves and which support the tube as the tube is bent. The grooves also have straight sections for quickly inserting a tube into the grooves from the side of the grooves. The amount of offset is accurately adjustable by a stop which is provided beneath the movable one of the shoes and the axial position of the offset relative to one end of the tube is accurately adjusted by another tube end stop. In addition, inner and outer tube deburring tools can be provided on the bender, and the bender is preferably mounted on a portable cart.

17 Claims, 2 Drawing Sheets

OFFSET BENDER FOR TUBING

FIELD OF THE INVENTION

This invention relates to tube benders, and in particular to tube benders for electrical conduit.

BACKGROUND OF THE INVENTION

In modern building construction, electrical wires are often run in conduit, such as "EMT" (electrical metallic tubing), "IMC" (intermediate metallic conduit), "GRC" (galvanized rigid conduit) or PVC (polyvinylchloride) coated EMT, IMC or GRC. The tubing is first installed in the building and then the wires are pulled through it. When installed, the electrician frequently has to bend the tubing in order to route it between locations. Bends are commonly made with tools which are adapted for making a bend in a single direction in the tubing, for example, a 22.5°, 30°, 45°, 60° or 90° bend. However, when running a straight run of tubing and an obstruction is encountered, it is sometimes necessary or desirable to simply offset the tubing to go around the obstruction, i.e., the two ends of the tubing on either side of the bend end up parallel to one another. This type of bend is referred to as an offset bend. When two offset bends are made in the same plane to bring the ends into axial alignment with one another, it is know as a four point offset bend. When using the typical type of tool that bends in a single direction, for each offset bend, it requires that two bends be made of the same angle, with care given that the tubing on both sides of the two bends ends up parallel and in the same plane. If several pieces of tubing must be bent or if four point offset bends are made, the individual offset bends should be consistent, to produce a professional looking job.

Machines have been made which are particularly adapted to making offset bends. For example, U.S. Pat. Nos. 5,222,384; 4,829,806; 3,875,786; and 3,691,815 disclose such bending machines. However, a need continues to exist for a conduit bender which is capable, in a practical manner, of providing consistent, accurate, and variable offset bends.

SUMMARY OF THE INVENTION

The invention provides a tube bender for making an offset bend in a tube which can be used to easily and consistently make accurate offset bends of adjustable length and depth, including multiple offset bends in a single tube. The bender includes a pair of tube bending shoes, one of the shoes being fixed and one of the shoes being movable, and each shoe has a shaped groove in it for receiving a straight section of tube in both of the grooves in a starting position of the shoes relative to one another. The groove in the fixed one of the shoes has an outer upper side portion for holding an adjacent portion of the tube down and an inner lower side portion which curves downwardly the direction toward the movable shoe. The groove in the moveable one of the shoes has an outer lower side portion for holding an adjacent portion of the tube up relative to the movable shoe and an inner upper side portion which curves upwardly in the direction toward the other shoe. A pair of links pivotally connect the pair of tube bending shoes together so that axes of the grooves remain parallel as the movable shoe is swung downwardly relative to the fixed shoe. Swinging the movable shoe downwardly places an offset bend in the tube of a depth equal to the vertical distance the shoe was swung downwardly.

In an especially useful form, the bender has an adjustable stop for setting the depth of the offset. Preferably, the stop is provided beneath the movable shoe, so the depth of offset can be set by measuring the distance from the top of the stop to the bottom of the movable shoe in the starting position.

For additional ease of use, an elongated handle is provided for swinging the movable shoe relative to the fixed shoe with leverage, and the bender can be mounted on a movable frame. The bender can also be used to bend two different sizes of tubing if grooves of one size are provided in one side of the shoes and grooves of a different size are provided in the other side. In another useful aspect, a stop is provided for limiting the insertion of a tube into the grooves in the shoes in the starting position, which helps to make accurate and consistent bends.

In a preferred form, the spacing of the shoes relative to one another in the starting position is adjustable. This may be accomplished by providing a number of spaced holes in the links, and is provided to adjust the length of the offset bend and the maximum depth.

To provide for fast loading of a straight tube into the bender, the groove in each shoe may further be provided with a straight portion which can be aligned along a straight line in an elevated position of the movable shoe above the straight position of the movable shoe with the straight portion of the other shoe. Thereby, a straight tube can be simultaneously loaded into both grooves by moving it into the straight portions from the side thereof, rather than sliding it in axially from the end of one of the grooves.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
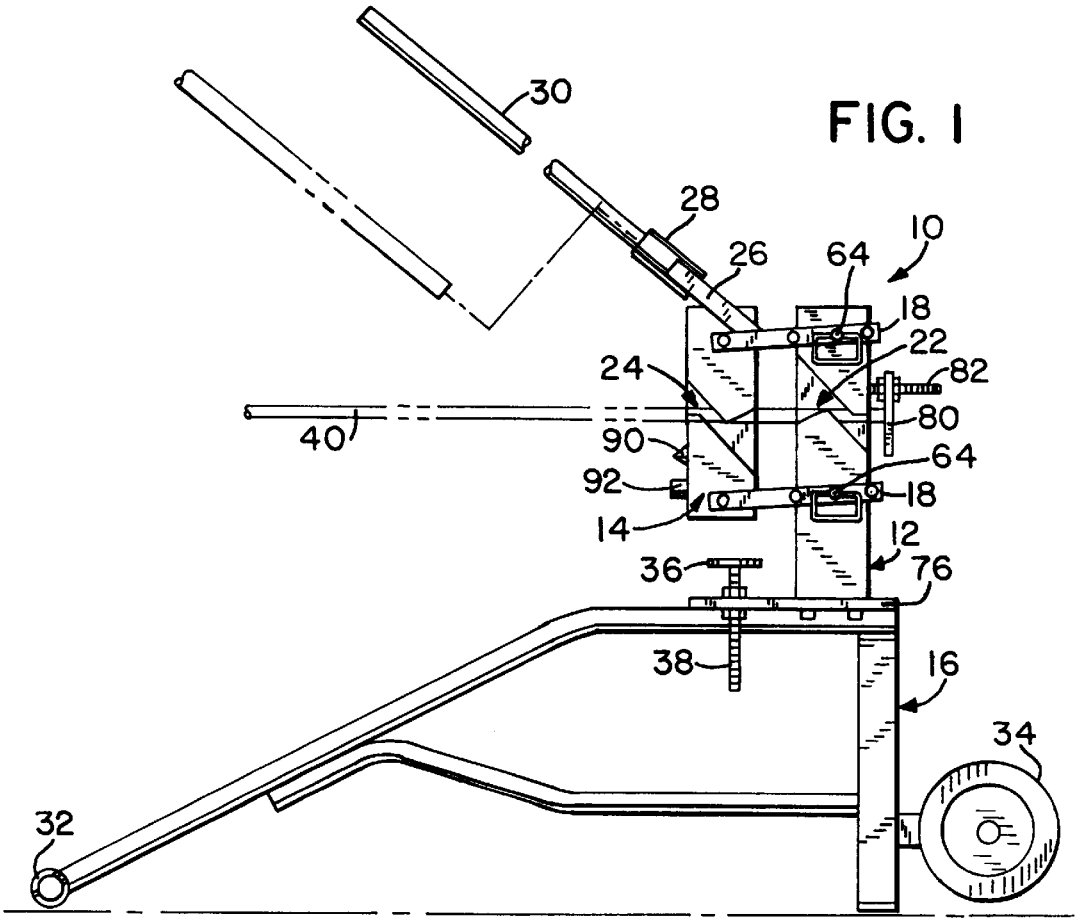
FIG. 1 is a side plan view of an offset bender of the invention in a starting position.

Referring to FIG. 1, a tube bender 10 of the invention includes two shoes 12 and 14 mounted to a frame 16. The shoes 12 and 14 are pivotally connected to one another by two pairs of links 18, with one of the pairs on each side of the shoes. Each shoe 12 and 14 has a respective groove 22, 24 formed in its side, and the grooves 22 and 24 are between the links 18 on that side. The upper links 18 on both side have an extension yoke 26 welded to them on which is welded a socket 28, into which can be inserted an elongated tubular handle 30 to gain leverage for operating the bender 10.

The frame 16 has a handle 32 and wheels 34 so that the bender 10 is portable. In addition, the frame 16 mounts a bender stop 36, which is adjustable by means of a screw thread 38, so that the depth of bend can be accurately adjusted and consistently repeated.

Figure 6:
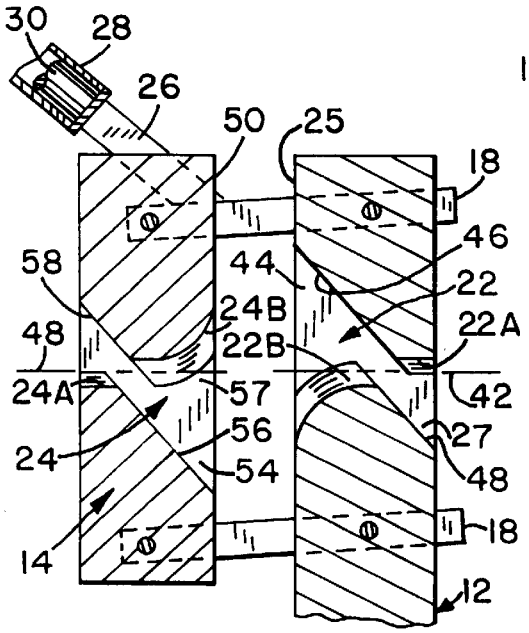
FIG. 6 is a partial sectional view along the plane of the line 6—6 of FIG. 4.
Figure 2:
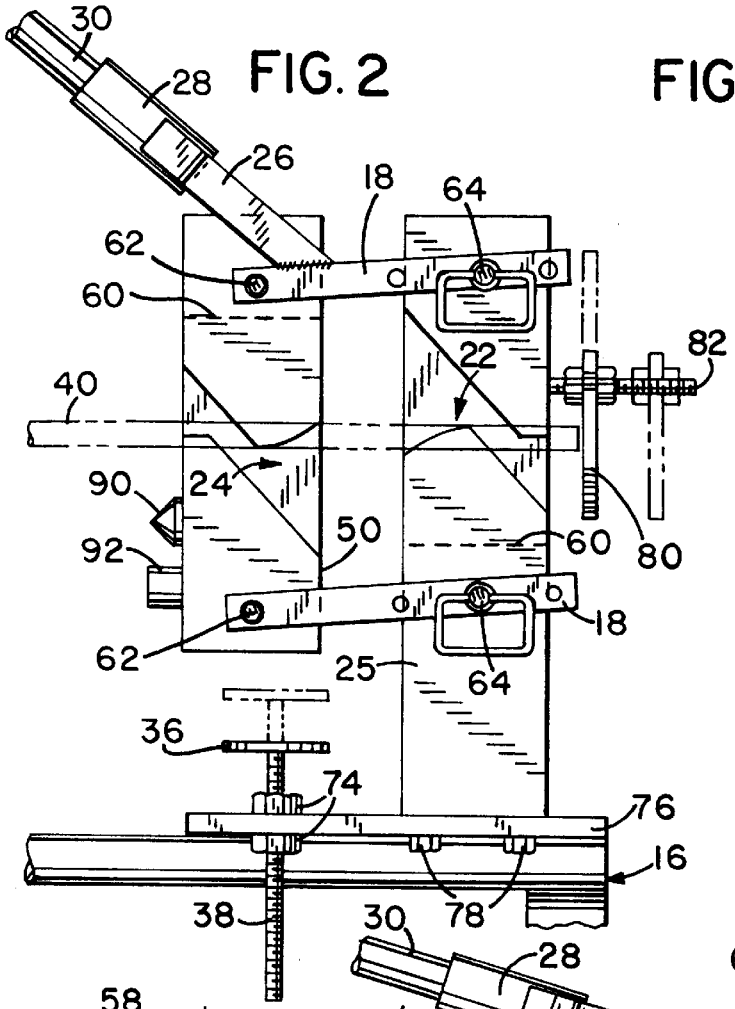
FIG. 2 is a detail view of the bender of FIG. 1 in the starting position.
Figure 3:
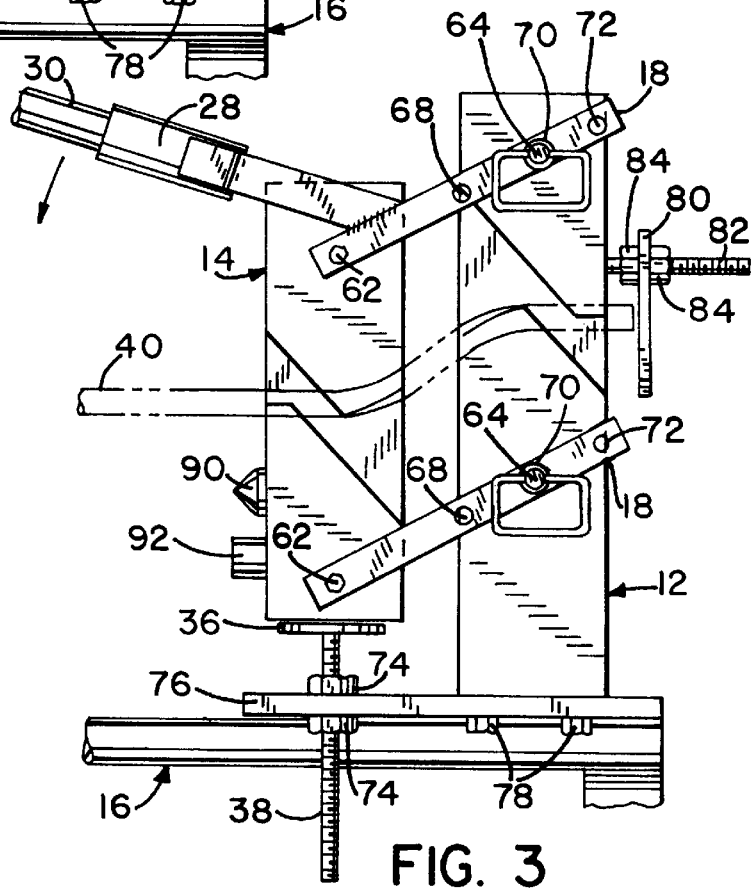
FIG. 3 is a view similar to FIG. 2, but in a finished position.

Referring particularly to FIGS. 2, 3, and 6, the grooves 22 and 24 are identical to one another, but the groove 24 is rotated 180° (in the vertical plane that contains it) relative to the groove 22. Each groove 22 and 24 has a number of portions which serve particular functions. The groove 22 has an upper outer side portion 22A (FIG. 6) with a semi-circular cross-section (FIGS. 5 and 6) sized to closely receive the outer diameter of the tube 40 to be bent and for holding the adjacent portion (typically the end) of the tube down as the tube is bent. The groove 22 also has an inner lower side portion 22B, of a similar semi-circular cross-section (FIGS. 5 and 6), which curves downwardly in the inward direction (i.e. in the direction toward the other shoe 14). The groove 22B defines at its inward end an arc of 90° of the minimum desired bend radius, which at its innermost radius is approximately tangent to the inner side surface 25 of the shoe 12. At its outer end (the end closest to groove portion 22A), the groove portion 22B is axially aligned along axis 42 with the groove portion 22A. Axis 42 defines the axis of the shoe 12.

A groove portion 44 defined by straight walls 46 and 48 separates the groove portion 22A from the groove portion 22B. The groove portion 44 has a flat bottom which is flush with the flat bottom of the entire groove 22. In other words, the entire bottom 27 of the groove 22 (and the bottom 57 of the groove 24) is flat and flush, including the area beneath the groove portion 22A (as viewed in FIG. 6), the area above the groove portion 22B, and the area between the walls 46 and 48.

As stated, the groove 24 is identical in shape to the groove 22, but since it is rotated by 180°, the groove portions serve somewhat different functions. Thus, groove 24 has an outer lower side portion 24A for holding an adjacent portion of a cradled tube up relative to the shoe 14 and an inner upper side portion 24B which curves upwardly in an inward direction (i.e., in the direction toward the other shoe 12). The portion 24B starts out at its outward end axially aligned along axis 48 with portion 24A and curves through a 90° arc of the minimum desired bend radius to be at a tangent with the inner side 50 of the shoe 14. The groove portions 24A and 24B, like the groove portions 22A and 22B, have a semi-circular cross-section (FIGS. 4 and 6) sized so as to closely the cradle the size of tube to be bent so as to support the tube against kinking when it is being bent.

In addition, groove 24 has groove portion 54 which separates the portions 24A and 24B and is defined by straight walls 56 and 58. As in the groove 22, the floor of the groove 24 is flat in the area between the wall 56 and the groove portion 24B and between the groove portion 24A and the wall 58.

Figure 5:
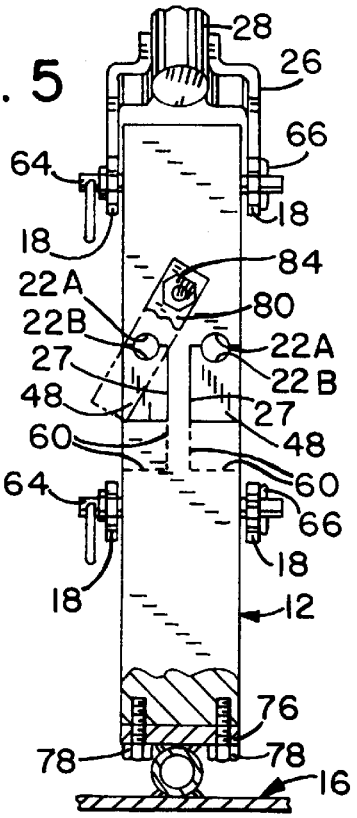
FIG. 5 is a partial right end plan view of the bender.
Figure 4:
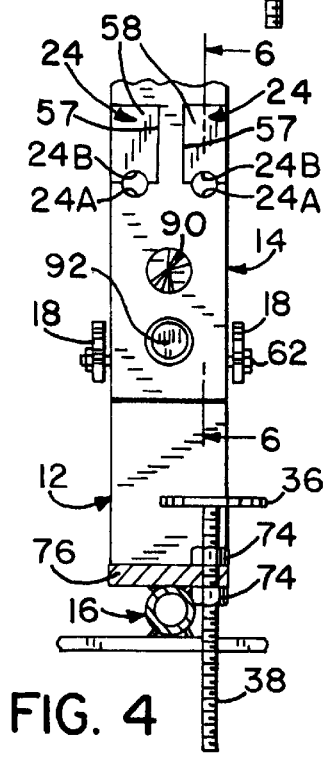
FIG. 4 is a partial left end plan view of the bender.

For ease of manufacture, each shoe 12, 14 can be formed in two or more pieces with the pieces bolted together. This may be done to simplify the forming of the semi-circularly shaped groove portions 22A, 22B, 24A, and 24B, as well as the overall grooves 22 and 24. If made in two or more pieces, dashed lines 60 in FIGS. 2 and 5 illustrate the boundary lines of a separate piece on which would be defined the groove portion 22B and wall 48 (respecting shoe 12) or the groove portion 24B on wall 58 (respecting shoe 14). These separate pieces would be bolted or otherwise suitably secured to the remainder of the respective shoe 12 or 14. Of course, it would also be possible to machine the grooves 22 and 24 in a single, unitary block of metal to make each respective shoe 12 and 14, as illustrated in FIGS. 1, 3 and 4.

The shoes 12 and 14 are pivotally connected by the four links 18, two of the links 18 on one side of the shoes 12, 14 and two of the links 18 on the other side of the shoes 12, 14, by pivotal connections. Bolts 62 may be run through the four links 18 and through the shoe 14, one bolt 62 above the groove 24 and one below the groove 24, to establish a pivotal connection between the links 18 and the shoe 14. At the other end of the links 18, the end that connects to the shoe 12, it is preferred to provide at least three spaced apart holes so that the axial spacing of the shoe 14 from the shoe 12 in the starting position illustrated in FIGS. 1 and 2, in which the axes 42 and 48 are aligned, is adjustable. This adjusts the length of the offset bend as well as the maximum depth of the offset bend. Thus, easily removable pins 64 pivotally connect the links 18 to the shoe 12 by being inserted through a hole at the adjacent end of the links 18 and through a throughhole in the shoe 12, one above the groove 22 and one below the groove 22, so that the axes 42 and 48 are always parallel as the shoe 14 is swung up and down relative to the shoe 12. The ends of the pins 64 which extend beyond the far side of the links 18 are each secured, for example, with an easily removable spring-type retaining pin 66.

In the preferred embodiment, three holes 68, 70, and 72 arc provided in the end of each link 18 which is pivotally secured to the shoe 12. The linkage is adjusted to the amount of bend desired. In the first, or shortest position, the holes 68 are used, which provides for a small offset up to, for example, one inch in offset between the axes 42 and 48 in the finally bent tube. In the medium, or middle position, the holes 70 are used for bends up to approximately 2½ inches of offset, for example. In the maximum bend position, the holes 72 of all the links 18 are used, for example, for offset bends up to approximately 4½ inches.

To precisely adjust the amount of offset, as briefly mentioned above, the stop 36 is provided which is threaded into the nuts 74. One of the nuts 74 is welded to mounting plate 76, which is bolted to shoe 12 by bolts 78 and forms part of the frame 16, and the other nut 74 is used as a locknut to secure the position of the stop 36. The stop 36 is adjusted by turning it to the desired position so that the shoe 14 can be moved downwardly relative to the shoe 12 and be stopped by the stop 36 to yield the desired offset in the axes 42 and 48. To adjust the amount of offset, a measurement is made from the top of the stop 36 to the bottom of the shoe 14 when the shoe 14 is in the starting position illustrated in FIG. 2, in which the axes 42 and 48 are generally aligned. The adjustment should be made to permit for a small amount of spring back in the tube, for example 1 1/16 of an inch.

A tube end stop 80, which is also preferably adjustable, being mounted on screw stud 82 which is fixed to the shoe 12 and secured with nuts 84, is also provided. The tube 40 is inserted into the grooves 22 and 24 until its end is stopped by the stop 80, which provides a consistent distance between the end of the tube 40 and the beginning of the offset bend. It also ensures that the tube 40 is well-seated and cradled in the groove portion 22A so that flattening of the end of the tube does not occur. The stop 80 can be swung up out of the way as illustrated in phantom in FIG. 2 if a bend is to be made in the middle of the tube or if it is not desired to be used.

Figure 7:
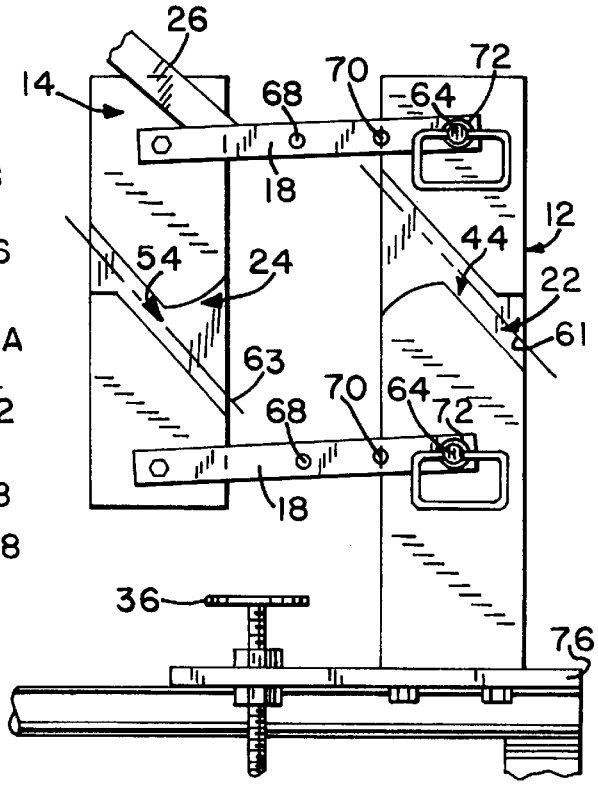
FIG. 7 is a view similar to FIG. 2, but showing the bender adjusted to make a longer offset.

The groove portions 44 and 54 are provided so that in any adjusted position of the links 18 relative to the shoe 12, the two groove portions 44 and 54 can be axially aligned along their axes 61 and 63 (FIG. 7) with one another by swinging the shoe 14 up from the starting position so that a straight tube can be inserted from the side into the groove portions 44 and 54, and the shoe 14 swung downwardly to engage the tube in the groove portions 22A, 22B, 24A and 24B. After this is done, the tube 40 can be slid axially (along axes 42 and 48) in the groove portions 22A, 22B, 24A, and 24B so as to abut its distal end against the stop 80. To do this, one may have to lift the handle 30 slightly to take the weight of the shoe 14 and handle 30 off of the tube. If the grooves 44, 54 were not provided, so that a straight tube could not be inserted into the grooves from the side, the tube could be inserted into the shoes 12, 14 from the handle side of the shoe 14, by holding the shoes in the starting position and inserting the tube through the groove portions 24A, 24B, 22B and 22A (in that order) until abutting the stop 80.

Preferably, as best illustrated in FIGS. 4 and 5, grooves 22 and 24 are provided on both sides of the shoes 12 and 14. On one side of the shoes 12 and 14, the semi-circular cross-section of the groove portions 22A, 22B, 24A, and 24B is sized for one size of tubing, for example ½ inch EMT, IMC or GRC, and on the other side the grooves 22 and 24 are sized for a different size, for example ¾ inch diameter. Thus, the same bender can be used for two different sizes of tubing. Also, as best illustrated in FIG. 5, the stop 80 can be swung from side to side to be usable with both sets of grooves.

An inside diameter deburring tool 90 and an outside diameter deburring tool 92, of conventional construction (essentially inside and outside cone shaped files), may be mounted on the bender 10. As illustrated, they are shown mounted on the outer face of the shoe 14. They could also be mounted elsewhere, for example, on the outer face of the shoe 12. The deburring tools 90 and 92 are used to remove blurs on the respective inside and outside diameters of cut tubing.

Thus, the invention provides a manually operated offset bending device for making offsets of any desired size from 0–4 inches (or more) with one sweeping motion of the handle. Bends are accurate and repeatable, and the device is portable and can be easily disassembled and assembled.

A preferred embodiment of the invention has been described in considerable detail. Many modifications and variations to the preferred embodiment described will be apparent to those skilled in the art. For example, it is preferred to provide a stop below the movable shoe 14 for ease of offset measurement and adjustment, but a stop could be provided between the shoes 12 and 14. In addition, while the stop 36 is illustrated as threaded into a nut which is welded to the frame 16, a separate plate could be provided to which was welded the nut and was bolted to the shoe 12, with the plate bolted to the frame 16. This way, the bender 10 could be adapted to mounting on a standard wheeled frame, which is useable for mounting a variety of tools. Thus, the invention should not be limited to the embodiment described, but should be defined by the claims which follow.

I claim:

1. A tube bender for making an offset bend in a tube, comprising:

a pair of tube bending shoes, one of said shoes being fixed and one of said shoes being movable, each said shoe having a groove therein for receiving a straight section of tube in both of said grooves in a starting position of said shoes relative to one another;

wherein said groove in said fixed one of said shoes has an outer upper side portion for holding an adjacent portion of said tube down and an inner lower side portion which curves downwardly in an inward direction, which is a direction toward said movable shoe, which side portions engage said tube in said starting position and are fixed relative to one another;

wherein said groove in said movable one of said shoes has an outer lower side portion for holding an adjacent portion of said tube up relative to said movable shoe and an inner upper side portion which curves upwardly in an inward direction, which is a direction toward said fixed shoe, which side portions engage said tube in said starting position; and a pair of links pivotally connecting said pair of tube bending shoes together so that axes of said grooves remain parallel as said movable shoe is swung downwardly relative to said fixed shoe, said tube extending between said pair of bending shoes being unsupported so that said shoes react against one another solely through said tube to make two spaced-apart bends in said tube.

2. A tube bender as claimed in claim 1, further comprising an elongated handle fixed to one of said links for swinging said movable shoe relative to said fixed shoe.

3. A tube bender as claimed in claim 1, further comprising a frame for supporting said fixed shoe.

4. A tube bender as claimed in claim 1, further comprising a stop positioned to abut said movable shoe to limit the downward motion of said movable shoe relative to said fixed shoe.

5. A tube bender as claimed in claim 4, wherein the vertical position of said stop is adjustable.

6. A tube bender as claimed in claim 5, wherein said stop is provided beneath said movable shoe.

7. A tube bender as claimed in claim 1, further comprising a stop for limiting the insertion of a tube into said grooves in said shoes in said starting position, said stop being positioned on a side of said fixed shoe opposite from said movable shoe and alignable with an axis of said fixed shoe.

8. A tube bender as claimed in claim 1, wherein the spacing of said shoes relative to one another in said starting position is adjustable.

9. A tube bender as claimed in claim 8, wherein said spacing is adjustable by virtue of spaced holes provided in said links.

10. A tube bender as claimed in claim 1, wherein said side portions of said grooves are semi-circular in cross-section so as to closely receive said tube and support said tube against kinking.

11. A tube bender as claimed in claim 1, wherein said grooves further comprise straight portions which can be aligned along a straight line in an elevated position of said movable shoe above said starting position of said movable shoe so that a straight tube can be moved into said straight portions simultaneously in said elevated position.

12. A tube bender as claimed in claim 1, wherein one of said links is above said grooves and the other of said links is below said grooves.

13. A tube bender as claimed in claim 12 further comprising another pair of said links, one of said pairs being provided on one side of said shoes and the other pair being provided on the other side of said shoes.

14. A tube bender as claimed in claim 1, wherein said shoes have grooves in one side for one size of tube and grooves in an opposite side for a different size of tube.

15. A tube bender as claimed in claim 1, wherein neither of said links is vertically alignable with an axis of said fixed shoe.

16. A tube bender as claimed in claim 1, wherein said tube extends unsupported between said grooves.

17. A tube bender for making an offset bend in a tube, comprising:

a pair of tube bending shoes, one of said shoes being fixed and one of said shoes being movable, each said shoe having a groove therein for receiving a straight section of tube in both of said grooves in a starting position of said shoes relative to one another;

wherein said groove in said fixed one of said shoes has an outer upper side portion for holding an adjacent portion of said tube down and an inner lower side portion which curves downwardly in an inward direction, which is a direction toward said movable shoe, which side portions engage said tube in said starting position;

wherein said groove in said movable one of said shoes has an outer lower side portion for holding an adjacent portion of said tube up relative to said movable shoe and an inner upper side portion which curves upwardly in an inward direction, which is a direction toward said fixed shoe, which side portions engage said tube in said starting position;

a pair of links pivotally connecting said pair of tube bending shoes together so that axes of said grooves remain parallel as said movable shoe is swung downwardly relative to said fixed shoe;

wherein one of said links is above said grooves and the other of said links is below said grooves; and another pair of said links, one of said pairs being provided on one side of said shoes and the other pair being provided on the other side of said shoes.

* * * * *